US005224309A

United States Patent [19]

Bodell

[11] Patent Number: 5,224,309

[45] Date of Patent: Jul. 6, 1993

[54] TEMPORARY CLEAT FOR SHEET GOODS

[76] Inventor: James R. Bodell, 11 Parker Rd., Pembroke, Mass. 02359

[21] Appl. No.: 772,062

[22] Filed: Oct. 7, 1991

[51] Int. Cl.[5] ..... E04F 21/00

[52] U.S. Cl. ..... 52/127.1; 248/544; 33/404; 52/105; 52/749

[58] Field of Search ..... 52/105, 749, 127.1; 248/544, 316.4, 245; 33/404, 405, 407, 648, 649

[56] References Cited

U.S. PATENT DOCUMENTS

| | | | |
|---|---|---|---|
| 920,941 | 5/1909 | Filken | 33/648 |
| 1,618,857 | 2/1927 | Barry | 248/245 |
| 2,889,632 | 6/1959 | Longhi | 33/648 |
| 3,250,584 | 5/1966 | Tassell | 248/544 |
| 3,350,787 | 11/1967 | Romano | 248/544 |
| 3,472,476 | 10/1969 | Johnson | 248/245 |
| 3,724,085 | 4/1973 | Wentworth | 248/544 |
| 3,861,111 | 1/1975 | McLeod | 52/749 |
| 3,865,338 | 2/1975 | Campbell | 248/245 |
| 4,225,108 | 9/1980 | Jaroche | 248/544 |
| 4,283,038 | 8/1981 | Kurtz | 248/316.4 |
| 4,314,429 | 2/1982 | Casteel et al. | 52/105 |
| 4,472,883 | 9/1984 | Ortega | 52/105 |
| 4,579,303 | 4/1986 | Midlik | 52/105 |
| 4,637,583 | 1/1987 | Babitz | 248/544 |
| 4,895,331 | 1/1990 | Nehls | 248/245 |

FOREIGN PATENT DOCUMENTS

| | | | |
|---|---|---|---|
| 724036 | 7/1942 | Fed. Rep. of Germany | 248/245 |
| 0290865 | 11/1989 | Japan | 52/749 |
| 1395780 | 5/1988 | U.S.S.R. | 52/749 |
| 584149 | 1/1947 | United Kingdom | 52/547 |
| 951322 | 3/1964 | United Kingdom | 248/245 |

*Primary Examiner*—Richard E. Chilcot, Jr.
*Assistant Examiner*—Joanne C. Downs
*Attorney, Agent, or Firm*—John P. McGonagle

[57] ABSTRACT

A cleat for supporting sheet goods during alignment and fastening to underlying support structures. A pattern of holes is provided in the cleat for use in fastening the cleat to strapped or non-strapped mounting surfaces. The ends are shaped to provide a means of positioning the first sheet as well as a subsequent sheets. A removable measured spacing plate is attached to the cleat so that the cleat may be positioned without the need to measure or use spacers.

12 Claims, 3 Drawing Sheets

TEMPORARY CLEAT FOR SHEET GOODS

BACKGROUND OF THE INVENTION

This invention relates to drywall construction, and more particularly to a cleat for temporarily holding a drywall in position while the drywall is being fastened to a supporting structure.

It is particularly useful in situations where position, size, weight, lack of sufficient manpower, or conditions of the sheet goods tend to make alignment and support awkward to have a means for temporarily holding a drywall in position. Braces, known as "dead men", and sheet goods lift systems have historically been used in these situations. These are, however, generally unwieldy, difficult to use, and often quite expensive.

SUMMARY OF THE INVENTION

In view of the foregoing disadvantages inherent in the known types of devices now present in the prior art, the present invention provides an inexpensive and easy to use cleat for supporting sheet goods during alignment and fastening to underlying support structures.

The cleat is constructed of a sturdy and durable material. A pattern of holes is provided in the cleat for use in fastening the cleat to strapped or non-strapped mounting surfaces. The ends are shaped to provide a means of positioning the first sheet as well as a subsequent sheets. A removable measured spacing plate is attached to the cleat so that the cleat may be positioned without the need to measure or use spacers.

The cleat of the instant invention provides a reliable means of alignment and support of sheet goods during the positioning and subsequent fastening process. The cleat is designed primarily as an aid in the installation of interior gypsum products, but it has useful applications with all sheet goods products, interior and exterior. The cleat will be of use on flat or cathedral ceilings where installers must align and maintain position of the sheet goods.

The cleat's low cost to produce, and the availability of power fasteners combine to offer an economical alternative to the use of dead men braces and the high cost of sheet goods lift systems.

These together with other objects of the invention, along with various features of novelty which characterize the invention, are pointed out with particularity in the claims annexed hereto and forming a part of this disclosure. For a better understanding of the invention, its operating advantages and the specific objects attained by its uses, reference should be had to the accompanying drawings and descriptive matter in which there is illustrated a preferred embodiment of the invention.

DETAILED DESCRIPTION OF THE INVENTION

Figure 1:
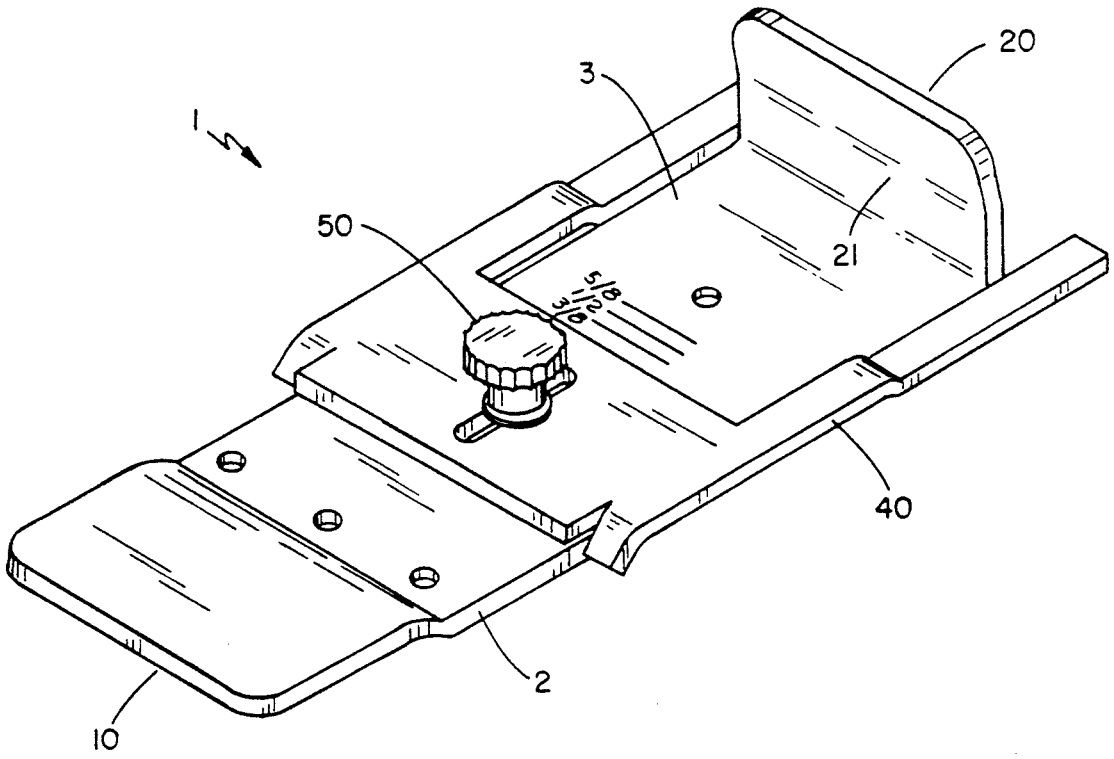
FIG. 1 is a perspective view of sheet goods cleat constructed according to the principles of the present invention.

Referring to the drawings in detail wherein like elements are indicated by like numerals, there is shown a cleat 1 constructed according to the principles of the present invention. The cleat 1 has a main body 2 formed from a flat, elongated, generally rectangular piece of metal. The cleat body 2 has a front face 3, rear face 4, two long sides 5, an offset end 1? and an angled end 20, The two ends 10, 20 of the cleat main body 2 differ in form and function. The cleat's offset end 10 starts along the cleat's longitudinal axis with a gentle bend 11 forward from the general plane of the front face 3 and is designed to ease a panel end 31 in, followed by a flat segment 12 parallel to the plane of the front face 3 and is intended to maintain the position of the panel end 31 after alignment, and a segment 13 bending to the cleat's front face 3 to create an offset. The offset segment 13 is required to position a sheet/panel of gypsum without a tapered edge to a sheet/panel with a tapered edge without adversely effecting the alignment of two tapered edges or two non-tapered edges.

The angled end 20, characterized in this embodiment by termination in a 90 degree forward flange 21 formed transversely to the cleat's longitudinal axis also has a gentle curve 22 formed at its end to ease a sheet/panel onto the cleat 1, and once again a flat area 23 to provide a landing for the sheet/panel end 31. The angled end 20 is used in the installation of sheet goods adjacent to a top plate.

The cleat 1 has an adjustable plate 40 that offers a self setting feature. The cleat's adjustable plate 40 permits the cleat 1 to be spaced down from a ceiling structure so as to position the cleat 1 without the need to measure or use spacers. The plate 40 is generally flat, has a generally U-shape, and lies in a plane parallel to the front face 3 of the cleat main body 2. The plate's width is greater than that of the cleat main body 2. The plate 40 has a base section 45 and two arms 41 extending therefrom thereby forming the U-shape. The plate 40 is positioned against the cleat main body 2 so that plate base 45 is nearest to the cleat main body offset end 10 and the plate's arms 41 are nearest the cleat main body's angled end 20. The plate's width exceed's the cleat main body's width by the width of the plate arms 41 which each lie just to the side 5 of the cleat main body 2. The arms 41 extend upward from the plate base section 45 past and to either side of the cleat main body flange 21.

The base section 45 has a central longitudinal slit 46 formed therein. A fastener assembly 50 comprised of a threaded stud 51 attached to and protruding from the main body front face 3, two washers 52, and a knurled thumb nut 53 threadingly engaging the stud 51 attaches the plate 40 to the front face 3 of the cleat main body 2. One washer 52 is placed onto the stud 51 and positioned directly against the cleat main body front face 3. The plate 40 is then positioned against the front face 3 so that the stud 51 protrudes through the plate slit 46. The second washer 52 is then placed onto the stud 51 and the thumb nut 53 then placed into engagement with the stud 51 This arrangement permits longitudinal adjustment of the plate 40 relative to the cleat main body 2 by loosening of the thumb nut 53, movement of the plate 40 to a desired position, and retightening of the nut 53. The cleat main body front face 3 is marked with measured transverse lines 7 indicating cleat spacings such as ⅝", ½", ⅜", and the like. The spacing is calibrated in terms of the distance between plate arm ends 42 and the cleat main body angled end 20.

For accuracy, the plate 40 must be kept square to the cleat main body 2. To assist in keeping the plate square to the cleat main body 2, an offset, transverse bend 43 is formed in each of the plate arms 41 at their approximate mid points. This causes the arms 41 to ride against the cleat main body sides 5. The plate base section corners 47 nearest to the cleat main body offset end 10 are bent past the cleat main body sides 5. The bent corners 47 and arm transverse bends 43 keep the plate 40 square to the cleat main body 2.

The cleat main body 2 has four holes 8, 9 formed through the front and rear faces 3, 4. The central holes 8 are used in the mounting of the cleat 1 vertically to wall studs 60. The cleat 1 is used in this position to assist in the installation of sheet goods 30 adjacent to structures such as ceiling joists 61 adjacent a wall. The holes 8 are also used in the horizontal position in installations where strapping is not a part of the ceiling structure, and sheet goods are fastened directly to the joist. The side mounting holes 9 are provided for use where strapping is an integral part of the ceiling structure.

When the cleat 1 is used to install gypsum products screw fasteners of the same type as used with the gypsum should be employed. In the installation of more substantial sheet goods such as plywood, the use of removable nails is indicated.

Figure 2:
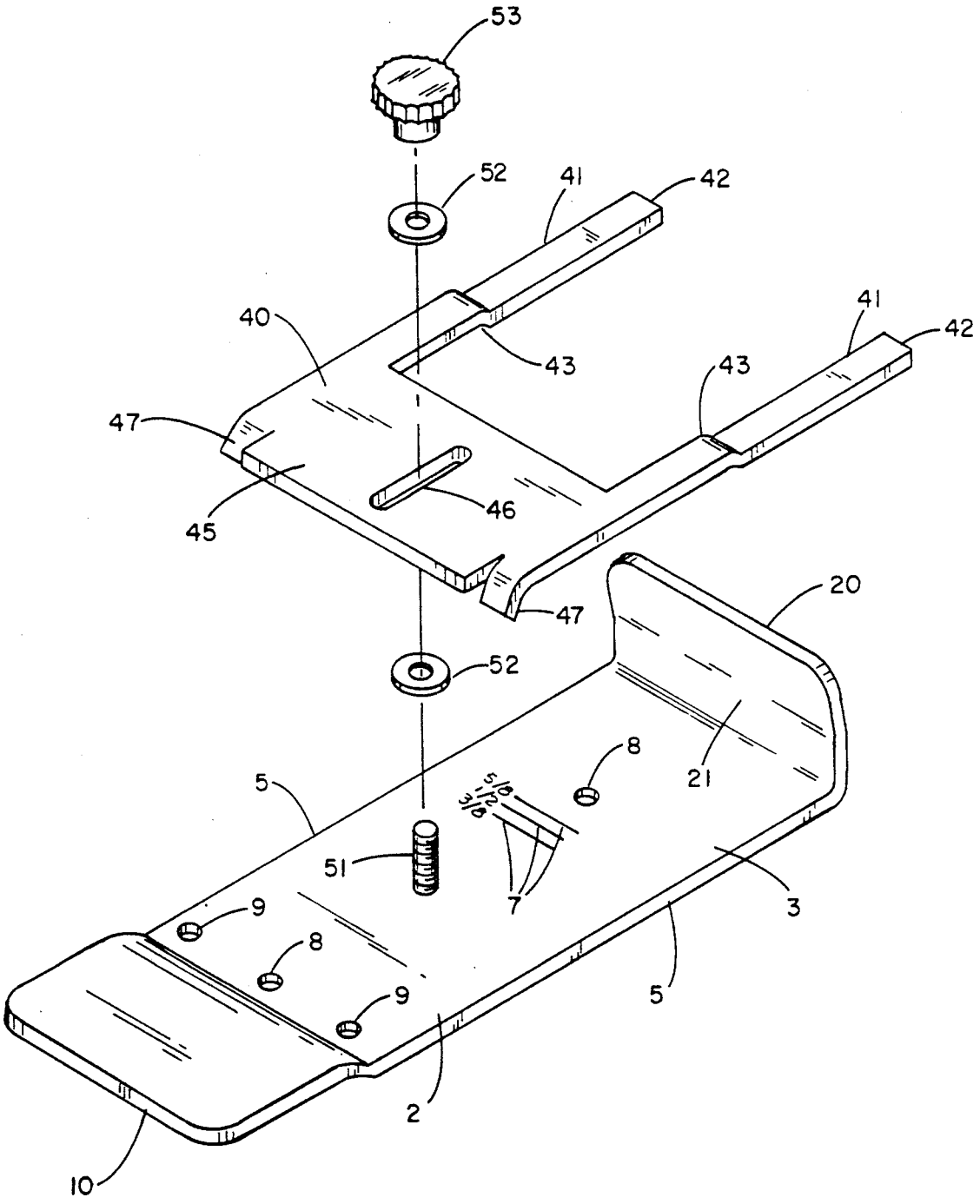
FIG. 2 is a an exploded view of the cleat of FIG. 1.
Figure 3:
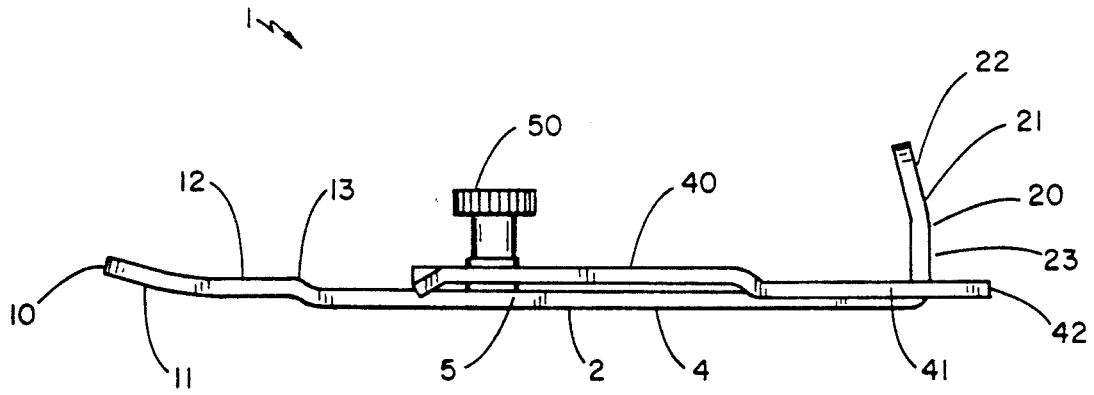
FIG. 3 is a side elevational view of the cleat of FIG. 1.
Figure 4:
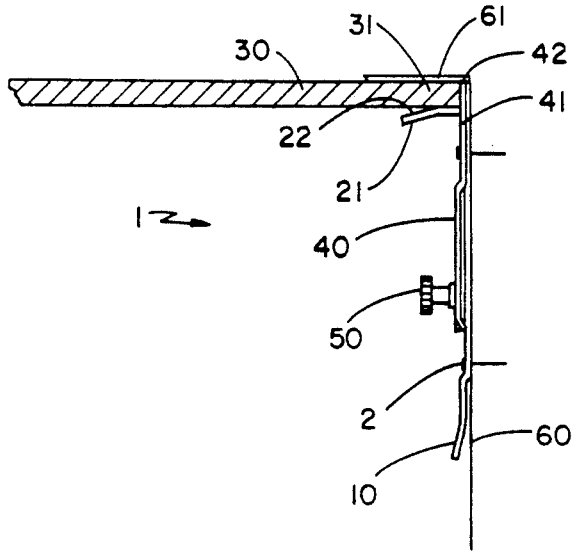
FIG. 4 is a side elevational view of the cleat of FIG. 1 vertically positioned and attached to a side wall to hold a ceiling panel.
Figure 5:
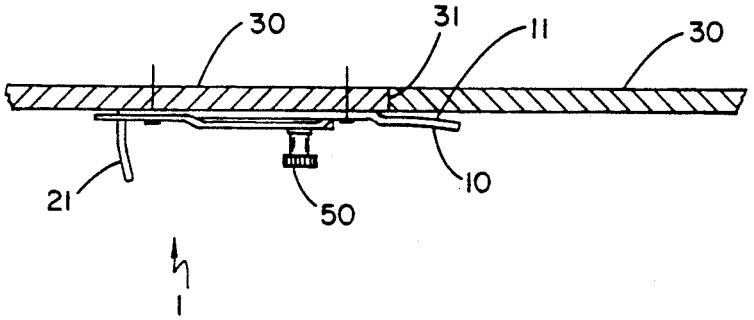
FIG. 5 is a side elevational view of the cleat of FIG. 1 horizontally positioned and attached to a ceiling panel to hold an adjacent ceiling panel.

It is understood that the above-described embodiment is merely illustrative of the application. Other embodiments may be readily devised by those skilled in the art which will embody the principles of the invention and fall within the spirit and scope thereof. Referring to FIG. 2, the cleat main body 2 alone, without the plate 40 and threaded element 51, may be used for most applications not requiring measured spacing from a ceiling structure.

I claim:

1. A cleat for temporarily holding sheet goods in position while the sheet goods are being fastened to a supporting structure, comprising:

a flat, elongated, generally rectangular main body, having a front face, rear face, two long sides, an offset end and an angled end, wherein said offset end starts along the cleat's longitudinal axis with a gentle bend forward from the general plane of the front face, followed by a flat segment parallel to the plane of the front face, and thereafter a segment bending to the cleat's front face to create an offset.

2. A cleat according to claim 1, wherein:

said angled end terminates in a forward flange formed transversely to the cleat's longitudinal axis, said flange having a flat portion forming a ninety degree angle with the cleat front face, said flat portion terminating in a curved end portion lying in a plane forming an angle with the plane of the cleat front face of less than ninety degrees.

3. A cleat according to claim 2, further comprising:

a generally flat plate adjustably connected to said main body front face, having a general U-shape and lying in a plane parallel to said main body front face.

4. A cleat according to claim 3, wherein:

the plate's width is greater than that of the cleat main body.

5. A cleat according to claim 4, wherein:

said plate has a generally rectangular base section and two arms extending therefrom thereby forming said U-shape.

6. A cleat according to claim 5, wherein:

said plate is positioned against the cleat main body so that the plate base is nearest to the cleat main body offset end and the plate's arms are nearest the cleat main body's angled end.

7. A cleat according to claim 6, wherein:

said plate's width exceeds the cleat main body's width by the width of the plate arms which each lie just to the side of the cleat main body, said arms extending upward from the plate base section past and to either side of the cleat main body flange.

8. A cleat according to claim 7, wherein:

said plate base section has a central longitudinal slit formed therein.

9. A cleat according to claim 8, further comprising a fastener assembly for attaching the plate to the front face of the cleat main body, comprising:

a threaded stud attached to and protruding from the main body front face;

two-washers positioned on said stud; and a knurled thumb nut threadingly engaging the stud;

wherein one washer is placed onto the stud and positioned directly against the cleat main body front face, and said plate is then positioned against the front face and first washer so that the stud protrudes through the plate slit, and the second washer is then placed onto the stud, and the thumb nut then placed into engagement with the stud, whereby longitudinal adjustment of the plate relative to the cleat main body is made by loosening of the thumb nut, movement of the plate to a desired position, and retightening of the nut.

10. A cleat according to claim 9, wherein:

said cleat main body front face is marked with measured transverse lines indicating cleat spacings, wherein said spacings are calibrated in terms of the distance between plate arm ends and the cleat main body angled end.

11. A cleat according to claim 10, wherein:

an offset, transverse bend is formed in each of the plate arms at their approximate mid points, wherein said arms will be caused to ride against the cleat main body sides; and the plate base section corners nearest to the cleat main body offset end are bent past the cleat main body sides.

12. A cleat according to claim 11, wherein:

the cleat main body has four holes formed through the front and rear faces, two of which are central holes used in the mounting of the cleat vertically to wall studs and horizontally in installations where strapping is not a part of the ceiling structure and sheet goods are fastened directly to the joist, and two of which are side mounting holes provided for use where strapping is an integral part of the ceiling structure.

* * * * *